US010594087B2

(12) United States Patent
Maesoba et al.

(10) Patent No.: US 10,594,087 B2
(45) Date of Patent: Mar. 17, 2020

(54) SHIELD CONNECTOR AND SHIELDED CABLE WITH CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Toshifumi Ichio, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/777,971

(22) PCT Filed: Nov. 24, 2016

(86) PCT No.: PCT/JP2016/084802
§ 371 (c)(1),
(2) Date: May 22, 2018

(87) PCT Pub. No.: WO2017/090683
PCT Pub. Date: Jun. 1, 2017

(65) Prior Publication Data

US 2018/0351306 A1 Dec. 6, 2018

(30) Foreign Application Priority Data

Nov. 24, 2015 (JP) ..... 2015-229223

(51) Int. Cl.
*H01R 13/648* (2006.01)
*H01R 13/6593* (2011.01)
*H01R 9/03* (2006.01)
(Continued)

(52) U.S. Cl.
CPC ..... *H01R 13/6593* (2013.01); *H01R 9/035* (2013.01); *H01R 13/6589* (2013.01); *H01R 4/184* (2013.01); *H01R 13/6473* (2013.01)

(58) Field of Classification Search
CPC ..... H01R 13/6593; H01R 9/035; H01R 13/6589; H01R 13/6473; H01R 4/184
(Continued)

(56) References Cited

U.S. PATENT DOCUMENTS 5,199,903 A * 4/1993 Asick ..... H01R 9/032 439/585
2007/0149054 A1 6/2007 Watanabe et al.
(Continued)

FOREIGN PATENT DOCUMENTS

JP 2007-180008 7/2007
JP 2007-184231 7/2007
(Continued)

OTHER PUBLICATIONS

International Search Report dated Feb. 28, 2017.

*Primary Examiner* — Abdullah A Riyami
*Assistant Examiner* — Nelson R. Burgos-Guntin
(74) *Attorney, Agent, or Firm* — Gerald E. Hespos; Michael J. Porco; Matthew T. Hespos

(57) ABSTRACT

A shield connector includes an inner housing to hold terminals connected to wires and a shield shell to accommodate the inner housing and the end of the shielded cable. The shield shell includes a base and a cover to cover the inner housing. The base includes a bottom plate to cover a lower surface of the inner housing and base-side plates to cover side surfaces of the inner housing. A front-rear restricting convex portion extends vertically and engages a front-rear restricting cut to restrict relative movements of the inner housing and the base in a front-rear direction. A vertical
(Continued)

restricting convex portion engages a vertical restricting hole to restrict relative vertical movements of the inner housing and the base.

6 Claims, 7 Drawing Sheets

(51) Int. Cl.
*H01R 13/6589* (2011.01)
*H01R 4/18* (2006.01)
*H01R 13/6473* (2011.01)

(58) Field of Classification Search
USPC ..... 439/607.41, 607.47, 607.56
See application file for complete search history.

(56) References Cited

U.S. PATENT DOCUMENTS

| | | | |
|---|---|---|---|
| 2007/0155243 | A1 | 7/2007 | Watanabe et al. |
| 2011/0300750 | A1 | 12/2011 | Nagawatari et al. |

FOREIGN PATENT DOCUMENTS

| | | |
|---|---|---|
| JP | 2009-266495 | 11/2009 |
| JP | 2011-086495 | 4/2011 |
| JP | 2012-18898 | 1/2012 |
| JP | 2013-125585 | 6/2013 |

* cited by examiner

SHIELD CONNECTOR AND SHIELDED CABLE WITH CONNECTOR

CROSS REFERENCE TO RELATED APPLICATION

The application claims priority on Japanese Patent Application No. 2015-229223 filed on Nov. 24, 2015, the entire disclosure of which is incorporated herein.

BACKGROUND

Field of the Invention

The invention relates to a shield connector and a shielded cable with connector.

Description of the Related Art

Conventionally, a shielded cable is utilized in communication between an electrical component (navigation device, ETC (Electronic Toll Collection) device, monitor or the like) installed in a vehicle such as an automotive vehicle and an external device (camera or the like) or between electrical components. A shielded cable for communication generally has wires including a communication wire, a shield conductor for collectively covering the wires and a sheath for covering the outer periphery of the shield conductor. The wire includes a conductor and an insulation coating provided on the outer periphery of the conductor.

Normally, a shield connector is attached to an end of a shielded cable. The shield connector is attached to the shielded cable by being connected to an end part of the shielded cable having a sheath removed to expose wires from a shield conductor. The shield connector includes an inner housing for holding terminals connected to conductor end parts of the wires and a shield shell for accommodating the inner housing and an end part of the shielded cable. The shield conductor is connector electrically to the shield shell.

Japanese Unexamined Patent Publication No. 2012-018898 discloses a shield connector that includes a shield shell having a bipartite structure by being vertically divided into two parts, namely, a base on which an inner housing is arranged and a cover to be mounted on the base to cover the inner housing and an end part of a shielded cable. The base has an upwardly open concave cross-sectional shape perpendicular to a longitudinal direction and includes a bottom plate and two side plates located on both sides of the bottom plate. On the other hand, the cover includes a cover plate in the form of a flat plate for entirely covering the base from above. The inner housing and the base are fixed by engaging locking recesses formed in both side surfaces of the inner housing and locking protrusions formed by cutting the both side plates of the base.

It is desired to suppress rattling of the inner housing and the base. Since each of the side surfaces of the inner housing and each of the side plates of the base are fixed at one position in Japanese Unexamined Patent Publication No. 2012-018898, it is difficult to effectively suppress the rattling of the inner housing and the base, particularly the inclination of the inner housing with respect to the base.

Accordingly, one object is to provide a shield connector capable of effectively suppressing the rattling of an inner housing and a base.

Another object is to provide a shielded cable with connector capable of effectively suppressing the rattling of an inner housing and a base.

SUMMARY

A shield connector of the present disclosure is to be connected to an end part of a shielded cable with wires including at least one communication wire and a shield conductor for collectively covering the wires. The shield connector includes an inner housing configured to hold terminals connected to conductor end parts of the wires, and a shield shell configured to accommodate the inner housing and the end part of the shielded cable. The shield shell includes a base, and the inner housing being arranged on the base. The shield shell also includes a cover to be fit to the base to cover the inner housing. The base includes a bottom plate configured to cover a lower surface of the inner housing and two base-side plates rising from both sides of the bottom plate to cover both side surfaces of the inner housing. One of the side surface of the inner housing and the base-side plate portion includes a front-rear restricting convex portion projecting toward the other, extending in a vertical direction and configured to restrict relative movements of the inner housing and the base in a front-rear direction, and a vertical restricting convex portion projecting toward the other and configured to restrict relative movements of the inner housing and the base in the vertical direction. The other of the side surface of the inner housing and the base-side plate includes a front-rear restricting cut formed from one end toward the other end in the vertical direction and to be engaged with the front-rear restricting convex portion, and a vertical restricting hole to be engaged with the vertical restricting convex portion.

According to the above-described configuration, the rattling of the inner housing and the base can be suppressed. This is because relative movements of the inner housing and the base in the front-rear direction and the vertical direction can be suppressed by the engagement of the front-rear restricting convex portion and the front-rear restricting cut portion and the engagement of the vertical restricting convex portion and the vertical restricting hole. Inclination of the inner housing with respect to the base also can be suppressed by these engagements. By restricting movements of the inner housing with respect to the shield shell in this way, impedance between the inner housing and the shield shell is unlikely to change. Thus, deterioration of communication quality due to an impedance mismatch in the shield connector can be effectively suppressed.

The front-rear restricting convex portion and the vertical restricting convex portion may be formed continuously, and the front-rear restricting cut and the vertical restricting hole may communicate. According to this configuration, the front-rear restricting convex portion and the vertical restricting convex portion are formed at one position of each side surface of the inner housing and each base-side plate. Thus, the front-rear restricting convex portion and the vertical restricting convex portion are formed easily as compared to the case where the front-rear restricting convex portion and the vertical restricting convex portion are formed independently without being formed continuously. By continuously forming the front-rear restricting convex portion and the vertical restricting convex portion, the inclination can be suppressed in addition to relative movements of the inner housing and the base in the front-rear direction and vertical direction even if the front-rear restricting convex portion and the vertical restricting convex portion are formed at one position.

The front-rear restricting cut and the vertical restricting hole in the base-side plate lead to efficiencies when assembling the inner housing and the base, as described in detail later.

Several of the vertical restricting convex portions and several of the vertical restricting holes may be provided at intervals in the front-rear direction. According to this configuration, the inclination of the inner housing with respect to the base is suppressed more easily suppressed.

There may be two vertical restricting convex portions and two vertical restricting holes. One vertical restricting convex portion and one vertical restricting hole may be continuous with the front-rear restricting convex portion and the front-rear restricting cut and the other vertical restricting convex portion and the other vertical restricting hole may be spaced apart from the one vertical restricting convex portion and the one vertical restricting hole. According to this configuration, relative movements of the inner housing and the base in the front-rear direction and vertical direction and the inclination of the inner housing with respect to the base can be suppressed even more effectively.

The front-rear restricting convex portion and the vertical restricting convex portion may be formed on the side surface of the inner housing, and the front-rear restricting cut portion and the vertical restricting hole may be formed in the base-side plate. According to this configuration, the front-rear restricting convex portion and the vertical restricting convex portion are exposed to outside from the front-rear restricting cut and the vertical restricting hole. Thus, an engaged state of the front-rear restricting convex portion and the vertical restricting convex portion with the front-rear restricting cut and the vertical restricting hole is confirmed easily from outside. Thus, whether or not the inner housing and the base are firmly fixed is confirmed easily.

A shielded cable with connector according to one aspect of the invention includes a shielded cable with wires including at least one communication wire and a shield conductor for collectively covering around the wires, and the above-described shield connector to be connected to an end part of the shielded cable. According to this configuration, the rattling of the shield connector and the shielded cable can be suppressed by including the shield connector capable of effectively suppressing the rattling of the inner housing and the base. Thus, communication quality can be improved.

DETAILED DESCRIPTION

Figure 1:
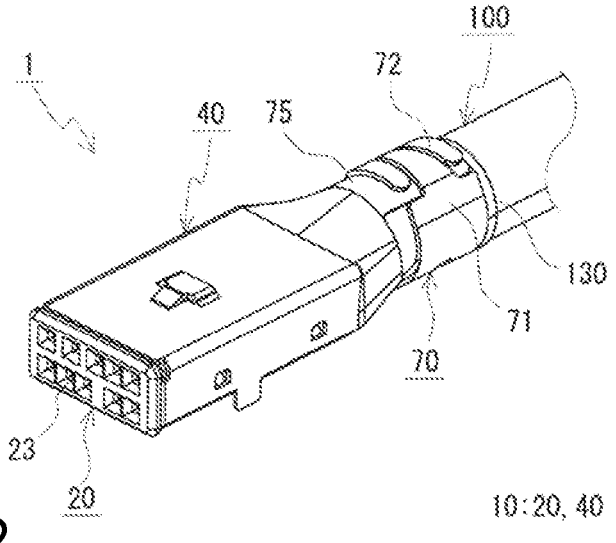
FIG. 1 is a schematic perspective view of a shielded cable with connector of one embodiment viewed from front.

Specific examples of a shield connector and a shielded cable with connector according to an embodiment of the present invention are described with reference to the drawings below. The same components are denoted by the same reference signs in the drawings. Note that the present invention is not limited to these illustrations and is intended to be defined by appended claims and include all modifications within the meaning and scope of the appended claims and equivalents.

[Shielded Cable with Connector]

Figure 2:
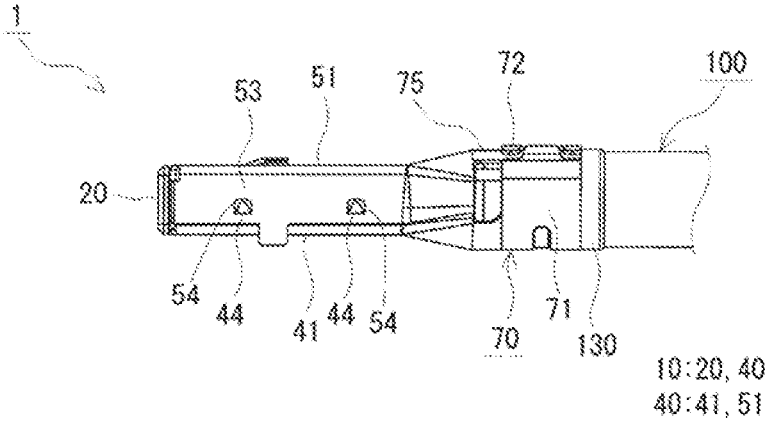
FIG. 2 is a schematic side view of the shielded cable with connector of the embodiment.
Figure 3:
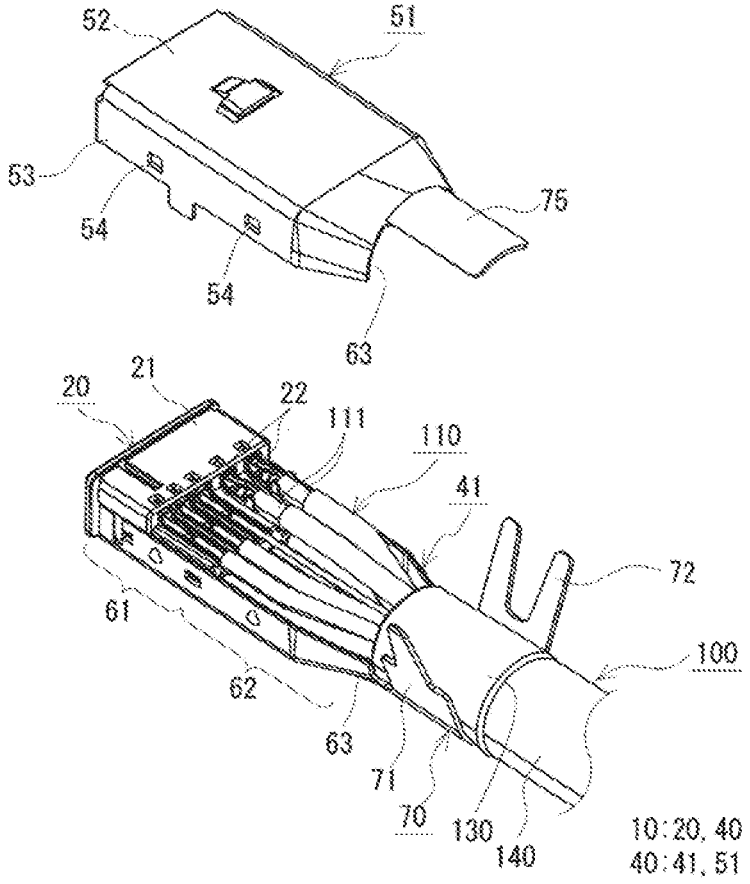
FIG. 3 is a schematic exploded perspective view of the shielded cable with connector of the embodiment viewed from behind.
Figure 4:
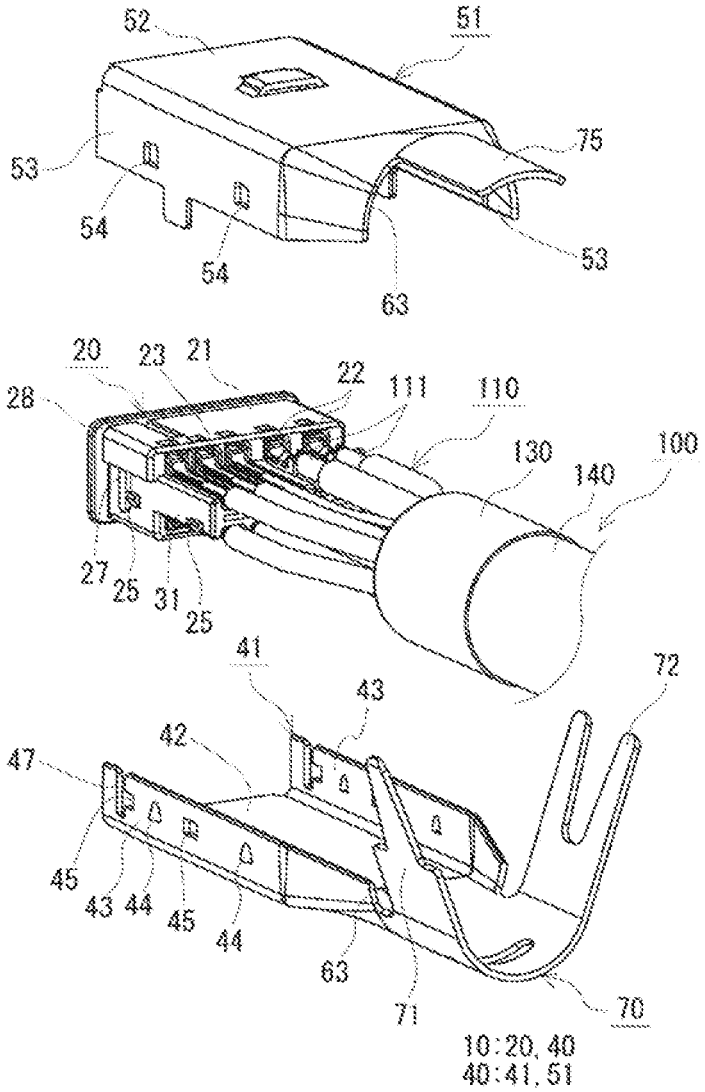
FIG. 4 is another schematic exploded perspective view of the shielded cable with connector of the embodiment viewed from behind.

With reference to FIGS. 1 to 9, a shielded cable with connector 1 according to one embodiment is described. As shown in FIGS. 1 and 2, the shielded cable with connector 1 includes a shielded cable 100 and a shield connector 10 to be connected to an end part of the shielded cable 100. The shield connector 10 includes an inner housing 20 and a shield shell 40 for accommodating the inner housing 20 and an end part of the shielded cable 100 as shown in FIGS. 3 and 4. The shield shell 40 includes a base 41, on which the inner housing 20 is arranged, and a cover 51 to be fit to the base 41. One feature of the shielded cable with connector 1 is a mounting structure of the inner housing 20 and the base 41. The configurations of the above featured part of the shielded cable with connector 1 and relating parts and main effects are successively described below. Then, each configuration is described in detail. In the following description, a side of the shield connector 10 on the side of the inner housing 20 is referred to as a front side (front surface), a side thereof on the side of the shielded cable 100 as a rear side, a side thereof on the side of the base 41 (bottom plate 42) as a lower side and a side thereof on the side of the cover 51 (upper plate 52) as an upper side.

[Shield Connector]

(Inner Housing)

Figure 6:
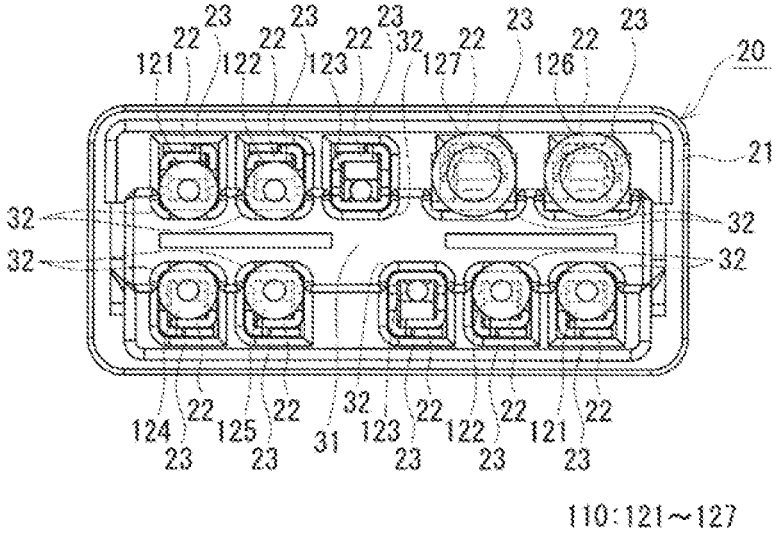
FIG. 6 is a schematic section showing the arrangement of wires in the end part of the shielded cable.
Figure 7:
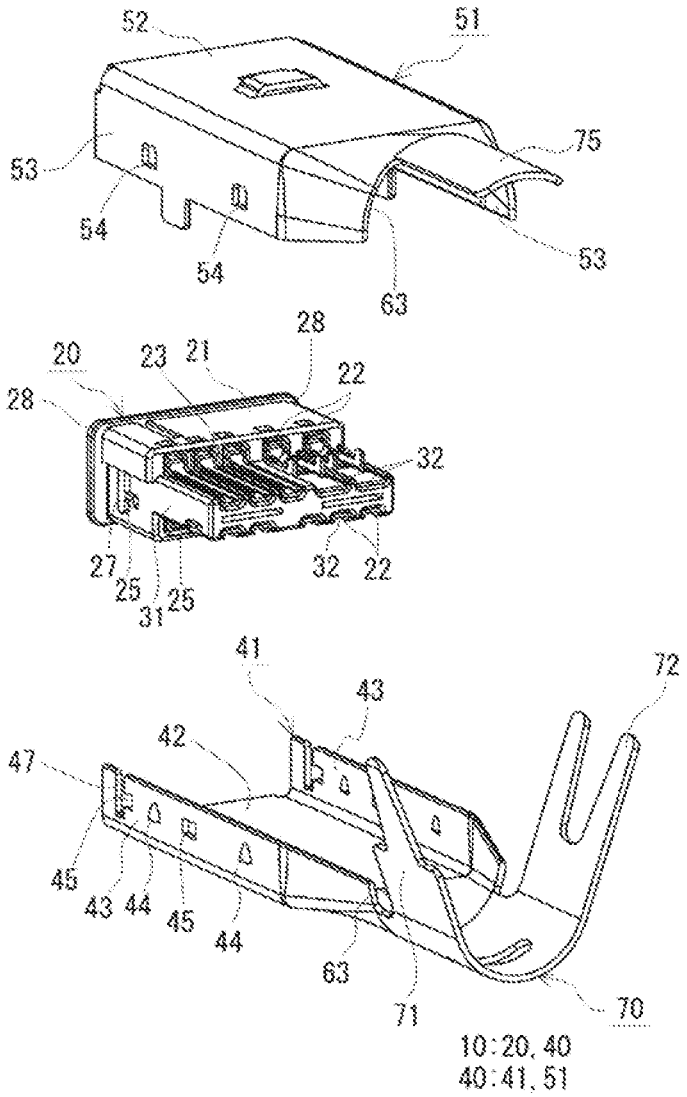
FIG. 7 is a schematic exploded perspective view of a shield connector of the embodiment.

As shown in FIGS. 4 and 6, the inner housing 20 holds terminals 22 connected to the end parts of conductors 111 of wires 110. Insulating resin can be cited as an example of a material of the inner housing 20. As shown in FIG. 7, the inner housing 20 includes a body 21 formed with terminal holes 23 for accommodating the terminals 22 and an arranging portion 31 which is integrally formed behind the body 21 and in which the end parts of the conductors 111 of the wires 110 are arranged. Five terminal holes 23 are formed side by side in each of upper and lower rows in the body 21 (see also FIG. 1) and the terminal 22 is inserted and accommodated in each terminal hole 23. The arranging portion 31 extends rearward from a vertically intermediate position of the body 21. As shown in FIGS. 6 and 7, the arranging portion 31 is formed with arrangement grooves 32 for arranging the end parts of the conductors 111.

(Shield Shell)

As shown in FIGS. 3 and 4, the shield shell 40 accommodates the inner housing 20 and the end part of the shielded cable 100. Conductive metal can be cited as an example of a material of the shield shell 40. As shown in FIG. 3, the shield shell 40 includes a housing accommodating portion 61 for accommodating the inner housing 20, a wire accommodating portion 62 for accommodating exposed end parts of the wires 110 and a cable inserting portion 63 for having the end part of the shielded cable 100 inserted thereinto in this order from front. The cable inserting portion 63 is formed with an opening shaped to correspond to an outer diameter of the shielded cable 100. As shown in FIG. 3, the end part of the shielded cable 100 is inserted such that a part of the shield conductor 130 is partly accommodated in the shield shell 40 and the remaining part is exposed from the cable inserting portion 63. The shield shell 40 is composed of the base 41, on which the inner housing 20 is arranged, and the cover 51 to be arranged on an upper side of the base 41 to cover the inner housing 20 and fit to the base 41 to cover the base 41 from above.

<Base>

As shown in FIG. 7, the base 41 is arranged on a lower surface side of the inner housing 20. The base 41 includes the bottom plate portion 42 configured to cover the lower surface of the inner housing 20 and extending toward the cable inserting portion 63 and a pair of base-side plate portions 43 rising from both sides of the bottom plate portion 42 to cover the both side surfaces of the inner housing 20. The base-side plate portions 43 are continuously formed toward the cable inserting portion 63. The base-side plate portions 43 are formed by cutting a metallic plate material into a predetermined shape and bending the cut piece.

(Mounting Structure of Inner Housing and Base)

Figure 8:
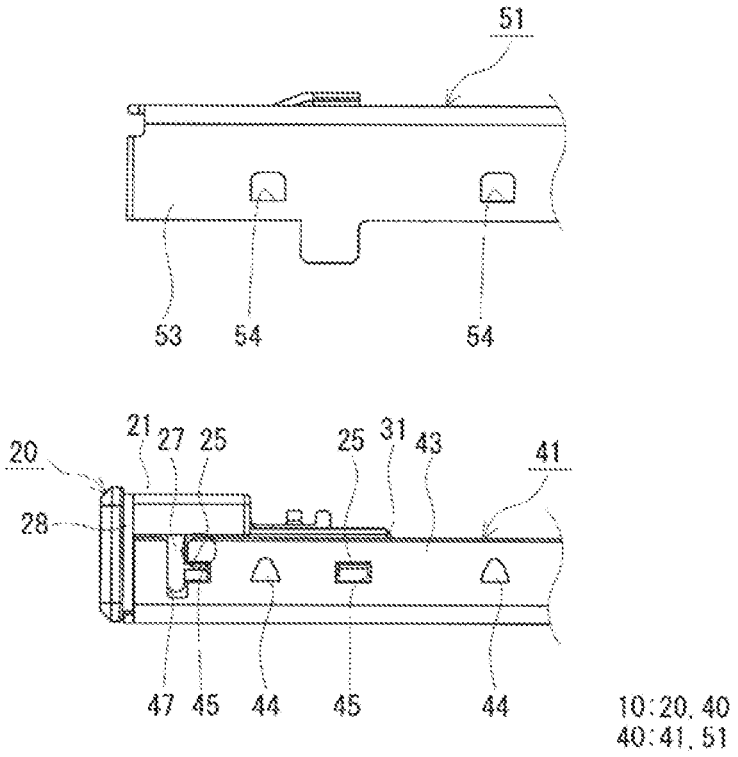
FIG. 8 is a schematic exploded perspective view of the shield connector of the embodiment.

The mounting structure of the inner housing 20 and the base 41 is such that the inner housing 20 and the base 41 are mounted integrally by engaging the side surfaces of the inner housing 20 and the base-side plates 43 with each other. This mounting structure specifically includes front-rear restricting convex portions 27 and vertical restricting convex portions 25 formed on either one of each side surface of the inner housing 20 and each base-side plate 43 to project toward the other and front-rear restricting cut portions 47 and vertical restricting holes 45 formed on the others and to be engaged with the respective convex portions 27, 25 (FIGS. 7 and 8). Although only left side surfaces are shown in FIGS. 7 and 8, the same holds for the right side surfaces on an opposite side. Here, the front-rear restricting convex portions 27 and the vertical restricting convex portions 25 are integrally formed to the inner housing 20 on the side surfaces of the inner housing 20, and the front-rear restricting cuts 47 and the vertical restricting hole portions 45 are formed in the base-side plates 43. Note that, contrary to this mode, the front-rear restricting convex portions 27 and the vertical restricting convex portions 25 may be integrally formed on the inner surfaces of the base-side plates 43 and the front-rear restricting cuts 47 and the vertical restricting holes 45 may be formed in the side surfaces of the inner housing 20.

<Front-Rear Restricting Convex Portions>

The front-rear restricting convex portions 27 restrict relative movements of the inner housing 20 and the base 41 in a front-rear direction by being engaged with the front-rear restricting cuts 47. The front-rear restricting convex portion 27 is formed by a long vertical rib projecting from the side surface of the inner housing 20 toward the base-side plate 43 and extending in the vertical direction. The front-rear restricting convex portion 27 has a rectangular shape on the side surface of the inner housing 20. A projecting length of the front-rear restricting convex portion 27 is constant in the vertical direction and equal to or shorter than a thickness of the base-side plate 43. The front-rear restricting convex portion 27 is formed at a position near the front on the side surface of the body 21 of the inner housing 20.

<Vertical Restricting Convex Portion>

The vertical restricting convex portions 25 restrict relative movements of the inner housing 20 and the base 41 in the vertical direction by being engaged with the vertical restricting hole portions 45. Similar to the front-rear restricting convex portion 27, the vertical restricting convex portion 25 is formed to project toward the base-side plate 43 from the side surface of the inner housing 20. The vertical restricting convex portion 25 is tapered toward bottom, i.e. has a wedge shape having an inclined surface inclined to reduce a projecting length toward the bottom of the side surface of the inner housing 20. A maximum projecting length of the vertical restricting convex portion 25 is equal to or longer than the thickness of the base-side plate 43.

There may be a single vertical restricting convex portion 25 or a plurality of vertical restricting convex portions 25. If there is a single vertical restricting convex portion 25, the vertical restricting convex portion 25 may be formed at a position adjacent to the front-rear restricting convex portion 27 to be continuous with the front-rear restricting convex portion 27 or at a position spaced apart from the front-rear restricting convex portion 27 to be separated from the front-rear restricting convex portion 27. In the case of forming the vertical restricting convex portion 25 at the position adjacent to the front-rear restricting convex portion 27, the vertical restricting convex portion 25 may be in front of or behind the front-rear restricting convex portion 27. In the case of forming the vertical restricting convex portion 25 separated from the front-rear restricting convex portion 27, the vertical restricting convex portion 25 may be formed behind the front-rear restricting convex portion 27 if the front-rear restricting convex portion 27 is provided on the body portion 21 as described above, but preferably is formed on the arranging portion 31. If the vertical restricting convex portion 25 is provided on the arranging portion 31 while being separated from the front-rear restricting convex portion 27, the inclination of the inner housing 20 with respect to the base 41 is easily suppressed. In the case of providing a plurality of vertical restricting convex portions 25, the vertical restricting convex portions 25 may be arranged in parallel in the front-rear direction with one vertical restricting convex portion 25 formed at a position adjacent to the front-rear restricting convex portion 27 and the remaining vertical restricting convex portion(s) 25 formed at position(s) separated from the front-rear restricting convex portion 27 or with all the vertical restricting convex portions 25 formed at positions separated from the front-rear restricting convex portion 27.

Two vertical restricting convex portions 25 are arranged in parallel at intervals in the front-rear direction. The front vertical restricting convex portion 25 is formed behind the front-rear restricting convex portion 27 to be continuous with the front-rear restricting convex portion 27, and the rear vertical restricting convex portion 25 is formed on the arranging portion 31 independently of the front-rear restricting convex portion 27 and the front vertical restricting convex portion 25.

<Front-Rear Restricting Cut>

The front-rear restricting cut 47 is engaged with the front-rear restricting convex portion 27. The front-rear restricting cut 47 is formed from one vertical end toward the other vertical end of the base-side plate portion 43. The front-rear restricting cut 47 is formed from an upper end edge toward a lower end. Specifically, the front-rear restricting cut 47 is open on the upper end edge side of the base-side plate 43. The front-rear restricting cut 47 has a vertically long rectangular shape.

<Vertical Restricting Hole>

The vertical restricting hole 45 is engaged with the vertical restricting convex portion 25. The vertical restricting hole 45 is formed to communicate with the front-rear restricting cut 47 when the vertical restricting convex portion 25 and the front-rear restricting convex portion 27 are formed continuously.

Two vertical restricting holes 45 are arranged in parallel at intervals in the front-rear direction. The front vertical restricting hole 45 is open to communicate with the front-rear restricting cut 47 and has a rectangular shape. Specifically, the front-rear restricting cut 47 and the vertical restricting hole 45 form a T-shaped hole. The rear vertical restricting hole 45 is entirely closed without being open to the surrounding and has a rectangular shape. Specifically, the rear vertical restricting convex portion 25 and the vertical restricting hole 45 can also restrict relative movements of the inner housing 20 and the base 41 in the front-rear direction in addition to restricting relative movements thereof in the vertical direction.

The inner housing 20 and the base 41 are mounted by fitting the inner housing 20 to the base 41 from above. In that way, the vertical restricting convex portions 25 and the front-rear restricting convex portions 27 of the inner housing 20 and the vertical restricting holes 45 and the front-rear restricting cuts 47 of the base-side plates 43 are engaged respectively, and the inner housing 20 is positioned and fixed to the base 41. The vertical restricting holes 45 and the front-rear restricting cuts 47 communicate and parts of the base-side plates 43 (parts enclosed by dotted line in FIG. 8) located above the vertical restricting holes 45 are cantilevered and supported. Thus, the above parts of the base-side plates 43 easily are opened outward to facilitate the engagement when the inner housing 20 is fit from above the base 41 and the vertical restricting convex portions 25 are engaged with the vertical restricting holes 45.

[Functions and Effects in Main Featured Part of Shielded Cable with Connector]

The shielded cable with connector 1 of the embodiment exhibits the following effects.

The rattling of the inner housing 20 and the base 41 can be effectively suppressed. This is because relative movements of the inner housing 20 and the base 41 in the front-rear direction and the vertical direction can be effectively suppressed by the engagement of the front-rear restricting convex portions 27 and the front-rear restricting cuts 47 and the engagement of the vertical restricting convex portions 25 and the vertical restricting holes 45 and the inclination of the inner housing 20 with respect to the base 41 can be effectively suppressed by these engagements.

Deterioration of communication quality due to an impedance mismatch in the shield connector 10 can be effectively suppressed. This is because impedance between the inner housing 20 and the shield shell 40 is unlikely to change since movements of the inner housing 20 with respect to the shield shell 40 can be effectively restricted.

Assembling workability of the inner housing 20 and the base 41 is excellent. The front-rear restricting cuts 47 and the vertical restricting holes 45 communicate and the parts above the front vertical restricting holes 45 are cantilevered and supported. Thus, when the inner housing 20 is fit from above the base 41 to engage the front-rear restricting convex portions 27 with the front-rear restricting cuts 47, the cantilevered parts of the base-side plates 43 are made easily open outward by the vertical restricting convex portions 25.

Whether or not the inner housing 20 and the base 41 are firmly fixed is easily confirmed. By forming the inner housing 20 with the front-rear restricting convex portions 27 and the vertical restricting convex portions 25 and forming the base-side plates 43 with the front-rear restricting cuts 47 and the vertical restricting holes 45, the both convex portions 27, 25 are exposed to outside from the base-side plates 43 when the inner housing 20 and the base 41 are engaged. Thus, an engaged state of the inner housing 20 and the base 41 is confirmed easily from outside.

[Shielded Cable]

Figure 5:
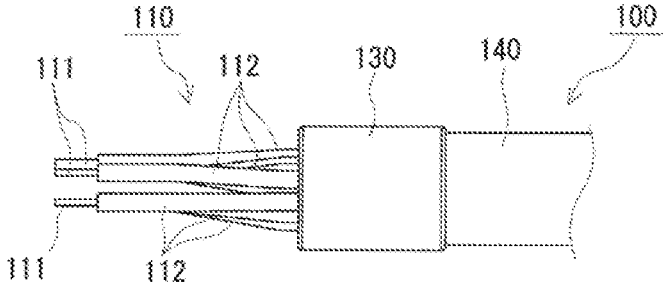
FIG. 5 is a schematic side view of an end part of a shielded cable.

The shielded cable 100 has the wires including at least one communication wire and the shield conductor for collectively covering around the wires. Here, the shielded cable 100 includes the plurality of wires 110, the shield conductor 130 for collectively covering around these wires 110 and a sheath 140 for covering the outer periphery of the shield conductor 130 as shown in FIGS. 3 to 5. The shield conductor 130 is formed of a braided wire made of conductive metal such as copper or aluminum, and the sheath 140 is formed of insulating resin, rubber or the like. At the end part of the shielded cable 100, the sheath 140 is removed, an end part of the shield conductor 130 is folded onto the sheath 140 as shown in FIG. 5 to expose end parts of the wires 110. End parts of the wires 110 are untwisted and branched in parallel, as shown in FIG. 4.

As shown in FIG. 6, the shielded cable 100 includes ten wires 110. Specifically, the shielded cable 100 includes two sets each composed of a pair of communication wires 121, 122 and a drain wire 123 (a total of six wires) for high-speed communication, one set composed of a pair of communication wires 124, 125 (a total of two wires) for low-speed communication, a power supply wire 126 (one wire) and a ground wire 127 (one wire). The communication wires 121, 122 are communication wires of USB (Universal Serial Bus) 3.0 standard (maximum communication speed: 5 Gbps) and constitute a differential pair cable with the drain wire 123. The communication wires 124, 125 are communication wires of USB 2.0 standard (maximum communication speed: 480 Mbps) and constitute a twisted pair cable. Each of the wires 110 excluding the drain wires 123 includes an insulation coating 112 (see FIG. 5) on the outer periphery of the conductor 111. At the end part of the shielded cable 100, end parts of five wires 110 are arranged in each of upper and lower rows as shown in FIG. 6 and end parts of the conductors 111 are exposed at tips of the wires 110 as shown in FIG. 5. FIG. 6 is a view of the inner housing 20 viewed from behind.

[Shield Connector]

(Inner Housing)

<Terminals>

The terminal 22 to be connected to the end part of the conductor 111 of the wire 110 is a female terminal made of conductive metal. This terminal 22 includes a rectangular tube to be accommodated into the terminal hole 23 of the body 21 and a plate-like part integrally formed behind the rectangular tube and to be connected electrically to the end of the conductor 111 (see FIG. 7). This plate-like part is arranged along the arrangement groove 32 of the arranging portion 31. As shown in FIG. 4, the end part of the conductor 111 is placed on this plate-like part and electrically connected by soldering. As shown in FIGS. 3 and 4, the inner housing 20 is arranged on the base 41 with the terminals 22 connected to the end parts of the conductors 111 of the wires 110.

<Vertical Grooves>

Figure 9:
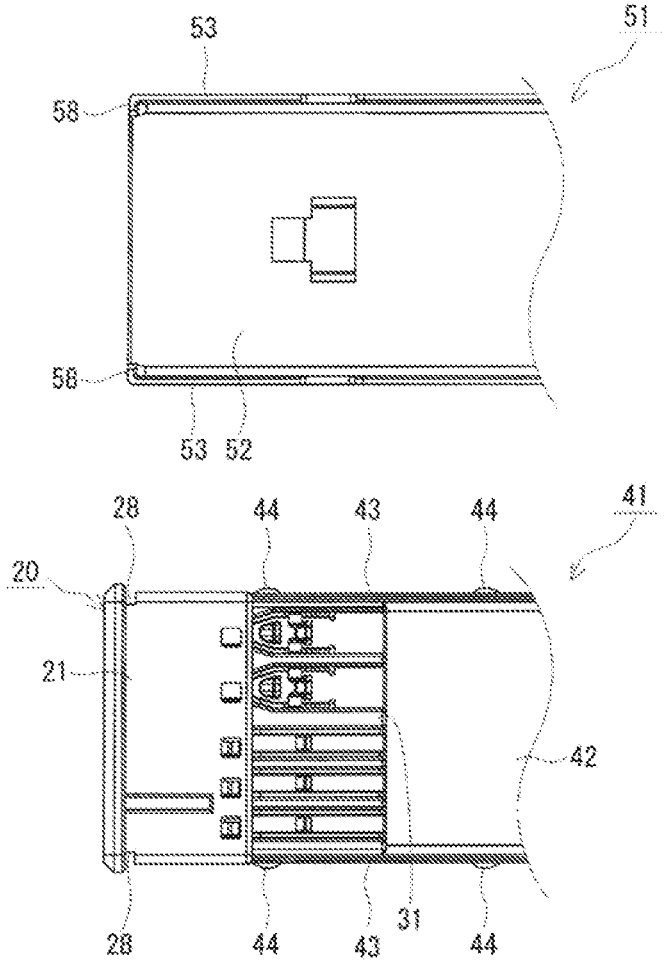
FIG. 9 is a schematic plan view showing a cover of a shield shell and a base having an inner housing arranged thereon in the shield connector of the embodiment.

As shown in FIGS. 8 and 9, vertical grooves 28 into which ridges 58 of cover-side plates 53 to be described later are inserted to position the cover 51 with respect to the inner housing 20 are formed in the side surfaces of the inner housing 20. An upper view of FIG. 9 is a schematic plan view of the cover 51 viewed from below, and a lower view is a schematic plan view of the base 41 having the inner housing 20 arranged thereon viewed from above. These vertical grooves 28 are formed along the vertical direction on a side of the body 21 before the front-rear restricting convex portions 27.

(Shield Shell)

<Base>

As shown in FIGS. 7 and 8, projections 44 for integrally fixing the base 41 and the cover 51 by being fit into fitting holes 54 of the cover-side plates 53 are on the outer surfaces of the base-side plates 43 of the base 41. This projection 44 projects out from the outer surface of the base-side plate 43. This projection 44 is formed into a dome shape bulging out. This projection 44 is formed by striking. An interruption is formed between the bottom of the projection 44 and the outer surface, but this interruption is not seen in a planar view of the outer surface of the base-side plate 43 (side surface of the base 41) as shown in FIG. 8. That is, a part where the projection 44 is formed is not open in a direction perpendicular to the outer surface of the base-side plate 43.

Barrel

As shown in FIGS. 3 and 4, a barrel 70 is provided on the rear end of the cable inserting portion 63 of the base 41 for electrically connecting the shield shell 40 and the shield conductor 130 by integrally fixing the shield shell 40 and the end part of the shield conductor 130. The barrel 70 is formed integrally to the cable inserting portion 63 to project farther rearward from the rear end of the cable inserting portion 63. The barrel 70 is U-shaped and includes two crimping pieces 71, 72 extending from both ends. By inserting the end part of the shield conductor 130 from above the barrel 70 and caulking the crimping pieces 71, 72, the crimping pieces 71, 72 are crimped to the end part of the shield conductor 130 (see FIG. 1). The barrel 70 is formed into a hollow cylindrical shape with the crimping pieces 71, 72 meshed with each other when the crimping pieces 71, 72 are caulked and crimped to the end part of the shield conductor 130. Specifically, the crimping piece 71 includes a tapered projecting piece and the crimping piece 72 includes a forked projecting piece having a V-shaped cut into which the projecting piece of the crimping piece 71 is fit.

<Cover>

As shown in FIG. 3, the cover 51 is mounted from above the base 41 with the inner housing 20 and the end part of the shielded cable 100 (wires 110) arranged on the base 41. The cover 51 includes the upper plate 52 configured to cover the upper surface of the inner housing 20 and extending toward the cable inserting portion 63, and two cover-side plates 53 rising from both sides of the upper plate 52 to overlap on outer sides of the base-side plates 43 (see also FIGS. 7 and 9). The cover-side plates 53 cover the vertical restricting holes 45 and the front-rear restricting cuts 47 of the base-side plates 43 by overlapping on the outer sides of the base-side plates 43 (see FIG. 2). The cover-side plates 53 are formed continuously toward the cable inserting portion 63. Similar to the base-side plates 43, the cover-side plates 53 are formed by bending a metallic plate material cut into a predetermined shape.

Ridges, Fitting Holes

As shown in FIG. 9, the ridges 58 are on the inner surfaces of the cover-side plate portions 53 for positioning the cover 51 with respect to the inner housing 20 by being inserted into the vertical grooves 28 formed in the inner housing 20. This ridges 58 project from the inner surface of the cover-side plate 53 toward the inner housing 20 and extend in the vertical direction. The ridges 58 are formed by bending the tips of the cover-side plates 53 inward. As shown in FIGS. 7 and 8, the fitting holes 54 are formed on the outer surfaces of the cover-side plates 53 for integrally fixing the cover 51 and the base 41 by being fit to the projections 44 of the base-side plates 43 when the cover 51 is fit to the base 41 (see FIG. 2).

Projecting Piece

As shown in FIG. 3, a projecting piece 75 for electrically connecting the shield shell 40 and the shield conductor 130 when the barrel 70 is crimped by caulking the crimping pieces 71, 72 (see FIG. 1) is provided on the rear end of the cable inserting portion 63 of the cover 51. The projecting piece 75 is integral to the cable inserting portion 63 to project farther rearward from the rear end of the cable inserting portion 63 to face the barrel 70. The projecting piece 75 is formed into an arcuate shape to extend along the outer peripheral surface of the shielded cable 100. The projecting piece 75 is located inside the crimping pieces 71, 72 to be pressed and contact the end part of the shield conductor 130 when the barrel 70 is crimped by caulking the crimping pieces 71, 72 (see FIG. 1).

The shielded cable with connector 1 according to the embodiment and the shield connector 10 provided in the shielded cable with connector 1 are suitably applicable to shielded cables for high-speed communication.

The shielded cable with connector 1 of the embodiment exhibits the following effects in addition to the aforementioned effects.

The intrusion and leakage of electromagnetic noise can be effectively suppressed and shielding properties are excellent. The cover-side plates 53 are overlapped with the base-side plates 43 to cover the vertical restricting holes 45 and the front-rear restricting cuts 47 of the base-side plates 43 and each of the base 41 and the cover 51 is formed continuously from the housing accommodating portion 61 to the cable inserting portion 63. Thus, a clearance is unlikely to be formed in a circumferential direction of the shield shell 40 and the inner housing 20 and the exposed end parts of the wires 110 can be covered around over the entire circumference by the shield shell 40.

Communication quality can be improved. This is because shielding properties in the shield connector 10 are high since the shield connector 10 is provided. Particularly, an improvement of communication quality can be expected in the case of application to the shielded cable including the communication wires 121, 122 for high-speed communication.

The shield connector 10 is assembled easily. This is because the cover 51 can be positioned and fixed to the base 41 by fitting the projections 44 of the base-side plates 43 and the fitting holes 54 of the cover-side plates 53. By forming the projections 44 by striking, the parts where the projections 44 are formed are not open in the direction perpendicular to the outer surfaces of the base-side plates 43 so that a clearance is not formed in the circumferential direction of the shield shell 40.

The inner housing 20 and the shield shell 40 are positioned more accurately. This is because the cover 51 can be positioned with respect to the inner housing 20 by inserting the ridges 58 of the cover-side plates 53 into the vertical grooves 28 of the inner housing 20.

Sufficient pull-out strength of the shielded cable 100 can be ensured. This is because, by including the projecting piece 75 facing the barrel 70, a fastening force can be dispersed when the crimping pieces 71, 72 are crimped and the shield connector 10 can be connected more firmly while excessive deformation of the end part of the shield conductor 130 by crimping can be prevented.

<<Modification>>

Figure 10:
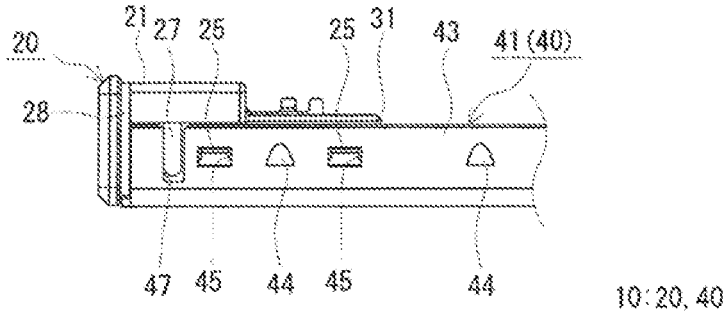
FIG. 10 is a schematic exploded side view showing an inner housing and a base of a shield connector of one modification.

One modification of the shield connector 10 in the shielded cable with connector 1 of the embodiment is described with reference to FIG. 10. A shield connector 10 of the modification differs from the embodiment in the mounting structure of the inner housing 20 and the base 41. In the mounting structure of the inner housing 20 and the base 41 in the embodiment, one of the plurality of vertical restricting convex portions is formed to be continuous with the front-rear restricting convex portion and the other vertical restricting convex portion is formed independently of (separately from) the front-rear restricting convex portion. In contrast, in the modification, none of a plurality of vertical restricting convex portions is formed to be continuous with a front-rear restricting convex portion and all the vertical restricting convex portions are separated from the front-rear restricting convex portion. Since the modification is similar to the embodiment except for a mounting structure of an inner housing 20 and a base 41, the following description is centered on points of difference.

(Mounting Structure of Inner Housing and Base)

The mounting structure of the inner housing 20 and the base 41 are composed of one front-rear restricting convex portion 27 and two vertical restricting convex portions 25 formed on each of both side surfaces of the inner housing 20 and one front-rear restricting cut 47 and two vertical restricting holes 45 formed in each base-side plate 43.

<Front-Rear Restricting Convex Portions, Vertical Restricting Convex Portions>

The front-rear restricting convex portions 27 are formed on both side surfaces of a body 21 as in the first embodiment. Two vertical restricting convex portions 25 are located behind the front-rear restricting convex portion 27, separated from the front-rear restricting convex portion 27 and separated from each other. The front vertical restricting convex portions 25 are formed on the both side surfaces of the body 21, and the rear vertical restricting convex portions 25 are formed on both side surfaces of an arranging portion 31. Note that the two front and rear vertical restricting convex portions 25 may be both formed on the side surface of the arranging portion 31.

<Front-Rear Restricting Cut Portions, Vertical Restricting Hole Portions>

The front-rear restricting cuts 47 and the two vertical restricting holes 45 are formed respectively at positions corresponding to the front-rear restricting convex portion 27 and the two vertical restricting convex portions 25 of the base-side plate 43. The two vertical restricting holes 45 have both a rectangular shape and both are closed entirely without being open to the surrounding.

The shield connector 10 of the modification can effectively suppress the rattling of the inner housing 20 and the base 41 similarly to the shield connector 10 of the embodiment.

The invention claimed is:

1. A shield connector to be connected to an end part of a shielded cable with wires including at least one communication wire and a shield conductor for collectively covering around the wires, comprising: an inner housing formed from an insulating resin and configured to hold terminals connected to conductor end parts of the wires; and a shield shell formed from a metal material and having opposite front and rear ends, the shield shell being configured to accommodate the inner housing and the end part of the shielded cable, wherein: the shield shell includes a base, the inner housing being arranged on the base, and the shield shell further including a cover to be fit to the base to cover the inner housing; the base includes a bottom plate configured to cover a lower surface of the inner housing and a pair of base-side plate rising from both sides of the bottom plate to cover both side surfaces of the inner housing, the side surface of the inner housing includes: a front-rear restricting convex portion projecting out, extending in a vertical direction and configured to restrict relative movements of the inner housing and the base in a front-rear direction; and a vertical restricting convex portion projecting out and configured to restrict relative movements of the inner housing and the base in the vertical direction; the side surface of the base-side plate includes: a front-rear restricting cut formed from one end toward the other end in the vertical direction and at a position spaced from the front and rear ends, the front-rear restricting cut to be engaged with the front-rear restricting convex portion; and a vertical restricting hole to he engaged with the vertical restricting convex portion; the vertical restricting convex portion extends continuously from the front-rear restricting convex portion; and the front-rear restricting cut and the vertical restricting hole communicate with one another.

2. A shield connector to be connected to an end part of a shielded cable with wires including at least one communication wire and a shield conductor for collectively covering around the wires, comprising: an inner housing formed from an insulating resin and configured to hold terminals connected to conductor end parts of the wires; and a shield shell formed from a metal material and having opposite front and rear ends, the shield shell being configured to accommodate the inner housing and the end part of the shielded cable,

| | | |
|---|---|---|
| 1 shielded cable with connector | | |
| 10 shield conductor | | |
| 20 inner housing | | |
| 21 body, | 22 terminal | 23 terminal hole |
| 25 vertical restricting convex portion | 27 front-rear restricting convex portion | 28 vertical groove |
| 31 arranging portion | 32 arrangement groove | |
| 40 shield shell | | |
| 41 base | | |
| 42 bottom plate | 43 base-side plate | |
| 44 projection | 45 vertical restricting hole | 47 front-rear restricting cut |
| 51 cover | | |
| 52 upper plate | 53 cover-side plate | |
| 54 fitting hole | 58 ridge | |
| 61 housing accommodating portion | | 62 wire accommodating portion |
| 63 cable inserting portion | | |
| 70 barrel | 71, 72 crimping piece | |
| 75 projecting piece | | |
| 100 shielded cable | | |
| 110 wire | | |
| 11 conductor | 112 insulation coating | |
| 121, 122 communication wire | | 123 drain wire |
| 124, 125 communication wire | | |
| 126 power supply wire | 127 ground wire | |
| 130 shield conductor | 140 sheath | |

wherein: the shield shell includes a base, the inner housing being arranged on the base, and the shield further including a cover to be fit to the base to cover the inner housing; the base includes a bottom plate configured to cover a lower surface of the inner housing and a pair of base-side plate rising from both sides of the bottom plate to cover both side surfaces of the inner housing, the side surface of the inner housing includes: a front-rear restricting convex portion projecting out, extending in a vertical direction and configured to restrict relative movements of the inner housing and the base in a front-rear direction; and a plurality of vertical restricting convex portions projecting out and configured to restrict relative movements of the inner housing and the base in the vertical direction; includes: a front-rear restricting cut formed from one end toward the other end in the vertical direction at a position spaced from the front and rear ends, the front-rear restricting cut and to be engaged with the front-rear restricting convex portion; and a plurality vertical restricting holes to be engaged respectively with the vertical restricting convex portions; the vertical restricting convex portions and the vertical restricting hole are provided at intervals in the front-rear direction.

3. A shield connector to be connected to an end part of a shielded cable with wires including at least one communication wire and a shield conductor for collectively covering around the wires, comprising: an inner housing formed from an insulating resin and configured to hold terminals connected to conductor end parts of the wires; and a shield shell formed from a metal material and having opposite front and rear ends, the shield shell being configured to accommodate the inner housing and the end part of the shielded cable, wherein: the shield shell includes a base, the inner housing being arranged on the base, and the shield shell further including a cover to be fit to the base to cover the inner housing; the base includes a bottom plate configured to cover a lower surface of the inner housing and a pair of base-side plate rising from both sides of the bottom plate to cover both side surfaces of the inner housing, the side surface of the inner housing includes: a front-rear restricting convex portion projecting out, extending in a vertical direction and configured to restrict relative movements of the inner housing and the base in a front-rear direction; and a vertical restricting convex portion projecting out and configured to restrict relative movements of the inner housing and the base in the vertical direction; includes: a front-rear restricting cut formed from one end toward the other end in the vertical direction at a position spaced from the front and rear ends, the front-rear restricting cut and to be engaged with the front-rear restricting convex portion; and a vertical restricting hole to be engaged with the vertical restricting convex portion; the front-rear restricting convex portion and the vertical restricting convex portion are formed on the side surface of the inner housing; and the front-rear restricting cut and the vertical restricting hole are formed in the base-side plate.

4. The shield connector of claim 1, wherein: there are a plurality of the vertical restricting convex portions and a plurality of the vertical restricting hole; and the vertical restricting convex portions and the vertical restricting hole are provided at intervals in the front-rear direction.

5. A shielded cable with connector, comprising: a shielded cable with wires including at least one communication wire and a shield conductor for collectively covering around the wires; and the shield connector of claim 1 connected to an end part of the shielded cable.

6. The shield connector according of claim 2, wherein: the front-rear restricting convex portion and the vertical restricting convex portion are formed on the side surface of the inner housing; and the front-rear restricting cut portion and the vertical restricting hole portion are formed in the base-side plate portion.

* * * * *